US008783485B2

(12) United States Patent
Logel et al.

(10) Patent No.: US 8,783,485 B2
(45) Date of Patent: Jul. 22, 2014

(54) CONTAINER

(75) Inventors: Valere Logel, Levallois Perret (FR); Dominique Bois, Montreuil aux Lions (FR)

(73) Assignee: Clariant Production (France) S.A.S., Trosly Breuil (FR)

( * ) Notice: Subject to any disclaimer, the term of this patent is extended or adjusted under 35 U.S.C. 154(b) by 362 days.

(21) Appl. No.: 12/742,661

(22) PCT Filed: Nov. 17, 2008

(86) PCT No.: PCT/EP2008/065651

§ 371 (c)(1),
(2), (4) Date: Sep. 7, 2010

(87) PCT Pub. No.: WO2009/063089

PCT Pub. Date: May 22, 2009

(65) Prior Publication Data

US 2011/0000930 A1 Jan. 6, 2011

(30) Foreign Application Priority Data

Nov. 16, 2007 (EP) ..... 07022316

(51) Int. Cl.
*B65D 53/00* (2006.01)

(52) U.S. Cl.
USPC ..... 215/320; 215/321; 220/849

(58) Field of Classification Search
USPC ..... 220/839, 849, 269; 215/320, 321, 337, 215/317, 237, 227
See application file for complete search history.

(56) References Cited

U.S. PATENT DOCUMENTS

| | | | | | |
|---|---|---|---|---|---|
| 2,814,404 | A | | 11/1957 | Towns | |
| 2,990,077 | A | * | 6/1961 | Van Baarn | 215/256 |
| 3,227,332 | A | | 1/1966 | Gowdy et al. | |
| 3,255,907 | A | | 6/1966 | Eddy | |
| 3,272,368 | A | | 9/1966 | Van Baarn | |
| 3,441,161 | A | * | 4/1969 | Van Baarn | 215/235 |
| 3,494,496 | A | * | 2/1970 | Livingstone | 215/320 |
| 3,653,529 | A | * | 4/1972 | Segmuller | 215/256 |
| 3,749,277 | A | * | 7/1973 | Kinney | 220/785 |

(Continued)

FOREIGN PATENT DOCUMENTS

| | | |
|---|---|---|
| CH | 309026 | 8/1955 |
| DE | 9113114 | 2/1993 |

(Continued)

OTHER PUBLICATIONS

English translation of International Preliminary Report on Patentability pertaining to international application No. PCT/EP2008/056894.

(Continued)

*Primary Examiner* — David Fidei
(74) *Attorney, Agent, or Firm* — Scott R. Cox

(57) ABSTRACT

Container (100) for loosely stored products comprising a container body (10), a cover (20), and a hinge (22) placed between the container body (10) and the cover (20) wherein the cover (20) has a cylindrical inner wall (30) and a cylindrical outer wall (32), and the inner wall (30) is provided with a sealing portion (34) at the outer edge of the inner wall (30), wherein the vertical position. (A) of an apex (36) of the sealing portion (34) is smaller than the vertical height (B) of the outer wall (32).

21 Claims, 3 Drawing Sheets

(56) References Cited

U.S. PATENT DOCUMENTS

| | | | | | |
|---|---|---|---|---|---|
| 3,848,780 | A | | 11/1974 | Stull | |
| 3,872,993 | A | * | 3/1975 | Aichinger et al. | 215/320 |
| 3,899,097 | A | * | 8/1975 | Aichinger | 215/253 |
| 3,986,627 | A | * | 10/1976 | Zapp | 215/237 |
| 4,043,475 | A | | 8/1977 | Wheeler | |
| 4,093,105 | A | | 6/1978 | Russell et al. | |
| 4,251,002 | A | * | 2/1981 | Middleton et al. | 215/253 |
| 4,345,607 | A | | 8/1982 | Contreras et al. | |
| 4,380,304 | A | | 4/1983 | Anderson | |
| 4,487,326 | A | * | 12/1984 | Uhlig | 215/307 |
| 4,498,608 | A | | 2/1985 | Mercil | |
| 4,531,650 | A | * | 7/1985 | Friendship | 215/256 |
| 4,589,431 | A | | 5/1986 | Yuhara | |
| 4,591,078 | A | | 5/1986 | Weissman et al. | |
| 4,640,435 | A | * | 2/1987 | Dutt | 220/790 |
| 4,713,219 | A | * | 12/1987 | Gerken et al. | 422/547 |
| 4,783,056 | A | | 11/1988 | Abrams | |
| 4,807,425 | A | | 2/1989 | Abrams | |
| 4,812,116 | A | | 3/1989 | Abrams | |
| 4,834,234 | A | | 5/1989 | Sacherer et al. | |
| 4,934,556 | A | | 6/1990 | Kleissendorf | |
| 4,940,167 | A | | 7/1990 | Fillmore et al. | |
| 4,964,539 | A | | 10/1990 | Mueller | |
| 4,982,872 | A | | 1/1991 | Avery | |
| 5,012,941 | A | | 5/1991 | Abrams et al. | |
| 5,108,029 | A | | 4/1992 | Abrams et al. | |
| 5,133,470 | A | | 7/1992 | Abrams et al. | |
| 5,139,165 | A | | 8/1992 | Hara | |
| 5,270,011 | A | * | 12/1993 | Altherr | 422/547 |
| 5,354,539 | A | * | 10/1994 | Hovatter | 422/550 |
| 5,381,920 | A | * | 1/1995 | Lin | 220/843 |
| 3,223,278 | A | | 12/1995 | Allen | |
| 5,474,177 | A | | 12/1995 | Abrams et al. | |
| 5,605,240 | A | | 2/1997 | Guglielmini et al. | |
| 5,667,094 | A | | 9/1997 | Rapchak | |
| 5,699,912 | A | | 12/1997 | Ishikawa et al. | |
| 5,723,085 | A | | 3/1998 | Abrams et al. | |
| 5,730,785 | A | | 3/1998 | Idol et al. | |
| 5,759,241 | A | | 6/1998 | Klett et al. | |
| 5,788,064 | A | | 8/1998 | Sacherer et al. | |
| 5,836,465 | A | | 11/1998 | King | |
| 5,842,486 | A | | 12/1998 | Davis et al. | |
| 5,894,949 | A | | 4/1999 | Taskis et al. | |
| 5,911,937 | A | | 6/1999 | Hekal | |
| 5,947,274 | A | | 9/1999 | Taskis et al. | |
| 5,950,849 | A | * | 9/1999 | Ekkert et al. | 215/252 |
| 5,975,346 | A | * | 11/1999 | Imperato et al. | 220/831 |
| 6,000,550 | A | | 12/1999 | Simpson et al. | |
| 6,070,749 | A | | 6/2000 | Joulia | |
| 6,080,350 | A | | 6/2000 | Hekal | |
| 6,214,255 | B1 | | 4/2001 | Hekal | |
| 6,221,446 | B1 | | 4/2001 | Hekal | |
| 6,299,033 | B1 | | 10/2001 | VerWeyst et al. | |
| 6,398,067 | B1 | | 6/2002 | Belfance et al. | |
| 6,413,600 | B1 | * | 7/2002 | Slat | 428/35.7 |
| 6,461,026 | B1 | | 10/2002 | Wang | |
| 6,769,558 | B1 | | 8/2004 | Bucholtz | |
| 6,951,292 | B2 | | 10/2005 | Bando et al. | |
| 7,059,492 | B2 | | 6/2006 | Giraud et al. | |
| 7,198,161 | B2 | | 4/2007 | Bucholtz | |
| 7,213,720 | B2 | | 5/2007 | Giraud | |
| 7,537,137 | B2 | | 5/2009 | Giraud | |
| 2003/0029739 | A1 | | 2/2003 | Riemenschneider et al. | |
| 2003/0173325 | A1 | | 9/2003 | Mavin | |
| 2004/0065669 | A1 | | 4/2004 | Giraud et al. | |
| 2004/0173612 | A1 | | 9/2004 | Giraud | |
| 2005/0023183 | A1 | | 2/2005 | Banik et al. | |
| 2005/0258174 | A1 | | 11/2005 | Giraud | |
| 2007/0084735 | A1 | * | 4/2007 | Lancesseur et al. | 206/204 |
| 2007/0272646 | A1 | | 11/2007 | Lancesseur et al. | |

FOREIGN PATENT DOCUMENTS

| | | | |
|---|---|---|---|
| DE | 102005059675 | | 6/2007 |
| EP | 0208413 | A2 | 1/1987 |
| EP | 0328809 | A1 | 8/1989 |
| EP | 0379775 | | 8/1990 |
| EP | 0454967 | | 11/1991 |
| EP | 0824480 | | 2/1998 |
| EP | 1352844 | | 10/2003 |
| FR | 1159823 | | 2/1958 |
| FR | 2705646 | | 12/1994 |
| FR | 2812620 | | 2/2002 |
| GB | 248223 | | 3/1926 |
| GB | 769054 | | 2/1957 |
| GB | 812580 | | 4/1959 |
| GB | 2224309 | | 5/1990 |
| WO | 8908057 | | 9/1989 |
| WO | 9323305 | | 11/1993 |
| WO | 9414665 | | 7/1994 |
| WO | 9633108 | | 10/1996 |
| WO | 0153058 | A1 | 7/2001 |
| WO | 0194240 | A1 | 12/2001 |
| WO | 2004031046 | | 4/2004 |
| WO | 2004033339 | A1 | 4/2004 |
| WO | 2004096658 | | 11/2004 |
| WO | 2005074571 | | 8/2005 |
| WO | 2006037135 | | 4/2006 |

OTHER PUBLICATIONS

Office Action dated Apr. 24, 2008 with respect to U.S. Appl. No. 10/566,093.

Response filed Aug. 25, 2008 in response to Office Action dated Apr. 24, 2008 with respect to U.S. Appl. No. 10/566,093.

Final Office Action dated Nov. 10, 2008 with respect to U. Appl. No. 10/566,093.

Preliminary Amendment filed Feb. 10, 2009 with Request for Continuing Examination with respect to U.S. Appl. No. 10/566,093.

Final Office Action dated May 8, 2009 issued with respect to U.S. Appl. No. 10/566,093.

Amendment filed Aug. 20, 2009 in response to Final Office Action dated May 8, 2009 issued with respect to U.S. Appl. No. 10/566,093.

Preliminary Amendment filed Oct. 8, 2009 in response to Final Office Action dated May 8, 2009 issued with respect to U.S. Appl. No. 10/566,093.

Response, filed with the EPO on Apr. 29, 2009, to the International Search Report and Written Opinion issued Feb. 10, 2009 with respect to international application No. PCT/EP2008/065651.

Drawing of Van Sickle Plastics Co. 50cc Snap Top Vial, p. 445 of Statement of Facts by Triple S Plastics, D.I. 192 in *Triple S Plastics* v. *Capitol Vial, Inc., et al*., Case No. 97-cv-499-ACM, dated Jan. 29, 1999, that was published and/or made known to others in the U.S. By Triple S Plastics.

Drawings of Reinke Vial, pp. 70-79 of Reply by plaintiff Triple S Plastics, D.I. 255 in *Triple S Plastics* v. *Capitol Vial, Inc., et al*., Case No. 97-cv-499-ACM, dated Apr. 16, 1999, that was published and/or made known to others in the U. S. By Triple S Plastics.

Printed pages from Capitol Vial website, www.capitolvial.com/plasticcontainers.html, entitled "Innovative Plastic Containers," dated Aug. 31, 2000, published and/or made known to others internationally by Capitol Vial, Inc./CSP Technologies, Inc.

"Product Profile: Polymer Product Solutions" brochure, dated 2001, featuring Süd-Chemie Vial published and/or made known to others in the U.S. By Süd-Chemie Performance Packaging.

"Performance Packaging: Packaging & Desiccant Solutions" brochure, dated Jun. 2002, featuring Süd-Chemie Vial published and/or made known to others in the U.S. and France by Süd-Chemie AG.

"Diagnostic Industrty Will 'Flip' for Süd-Chemie's Moisture Adsorbent Polymer Tubes" news release, dated Feb. 10, 2004, featuring Süd-Chemie Vials published and/or made known to others in the U.S. by Süd-Chimie Performance Packaging.

(56) References Cited

OTHER PUBLICATIONS

Photographs and other documents regarding Süd-Chemie display booth at the 2004 AACC Clinical Lab Expo featuring Süd-Chemie vial on display, dated Jul. 27, 2004, used and/or made known to others in the U.S. by Süd-Chimie Performance Packaging.

European Patent Office Communication, dated Dec. 21, 2012, with respect to EP Application Serial No. 08 851 024.3-1261. European Patent Office Communication dated Dec. 21, 2012 with respect to EP Application Serial No. 08 851 024.3-1261.

* cited by examiner

CONTAINER

1. FIELD OF THE INVENTION

The present invention relates to a container for receiving loosely stored products, such as drugs, pills, tablets, test strips, granulate and even powder which has a container body and a cover, whereby a hinge is placed between the container body and the cover. For such purposes the container has to be airtight in order to avoid a deterioration of the stored products.

2. PRIOR ART

Containers of the above mentioned type are known and common to the skilled in the art. They usually comprise a cover that is integrally attached to the container, wherein the cover has a circular base with an outer periphery and a cylindrical tubular skirt extending perpendicularly and outwardly around the outer periphery of the base. Furthermore such containers have also an upper portion and an inner and outer surface, wherein the container having a cylindrical upstanding rim at the upper portion, the rim is defined as that portion of the container that contacts an inner wall of the skirt of the cover, and the rim having an inner and outer wall rim. Further, such covers comprise a thumb tab for facilitating the opening and closing of the container and at least one hinge attached to the container. The hinge has at least one hinge recess bend point that functions to rotate the cover at one pivot point. The thumb tab and the hinge are positioned on substantially opposing ends of the cover and extending, perpendicularly and outwardly from the skirt of the cover.

A flexible lip is often part of such containers, whereby the flexible lip is a projection that projects concentrically from an interior surface of the base of the cover. When the skirt of the cover overlies the container and at least a portion of the rim of the container engages the inner wall of the skirt of the cover, the flexible lip interacts with the rim to sufficiently deflect so as to form a releasable seal between the cover and the container.

One of the main criteria of such containers is the air tightness in order to protect the stored products as good as possible. Improved demands in this respect require a very exact manufacturing of the containers particular the sealing portions. In prior art containers reliability of the containers can not be guaranteed due to manufacturing defects at the sealing portions.

Further, since such containers with hinged covers are intended to be opened and closed several times mainly by hand this may again impair air tightness of the container according the prior art.

The resealable container according to U.S. Pat. No. 6,769,558 B1 consists essentially of a container having a rim at its upper portion, and a cap having a circular base with an outer periphery, a cylindrical tubular skirt, the inner wall of which has at least one recess, and a hinge connecting the cap to the container. In a closed position, the skirt of cap overlies the container and the rim of the container is situated within the recess of the inner wall of the skirt of the cap.

Based an the explained disadvantages as well as by considering the explained prior art for containers of the above mentioned art, the aim of this invention is to provide a container of the above mentioned type, which has an improved tightness even when opened and closed several times, can be easily manufactured and provides an improved reliability.

3. SUMMARY OF THE INVENTION

This goal is achieved according to the invention by claim 1. Advantageous improvements result from the sub claims.

Particularly the invention provides a container for loosely stored products comprising a container body a cover and a hinge, placed between the container body and the cover wherein the cover has a cylindrical inner wall and a cylindrical outer wall wherein the inner wall is provided with a sealing portion at the outer edge of the inner wall wherein the vertical position of an apex of the sealing portion is smaller than the vertical height of the outer wall.

Since the sealing portion is provided at the outer edge of the inner wall and the vertical position of an apex of the sealing portion is smaller than the vertical height of the outer wall the sealing portion is protected against undesired contact by means of the outer wall. Even if the container is shipped or handled in open state the sealing portion of the cover is protected against damages. This increases air tightness of the container and overall reliability due to fail safe handling.

The apex or sealing line of the sealing portion is arranged within a groove formed between inner and outer wall. This groove is usually very narrow, such that it is unlikely that the apex of the sealing portion at the inner wall is contacted or even damaged.

In a first preferred embodiment the vertical position A of the apex of the sealing portion is 2.0-15.0 mm, preferably 2.0-10.0 mm, more preferably 3.9 mm, and the vertical height B of the outer wall is 2.1-15.1 mm, preferably 2.1-10.1 mm, more preferably 4.2 mm. The apex of the sealing portion is protected by a preferably 0.3 mm higher outer wall.

In a further embodiment the sealing portion seen in a transversal section is provided with a first radius R1 defining an outer apex. In an embodiment the first radius R1 is 0.5-3.0 mm, preferably 0.7-0.9 mm and more preferably 0.8 mm.

Since the sealing portion comprises a rather small radius a well defined contact line with the inner wall surface of the container body results which guarantees on the one hand an improved air-tightness and on the other hand allows opening and closing of the container without damaging the sealing portion.

In a further embodiment the sealing portion comprises a second radius R2 between the first radius R1 and an end surface of the inner wall, wherein the second radius R2 is smaller than the first radius R1. In an embodiment the second radius R2 is 0.05-2.0 mm, preferably 0.10-0.50 mm and more preferably 0.15 mm.

This second radius eliminates the risk of damaging the inner wall surface of the container body and thereby improves again air-tightness of the container.

Preferably, the inner wall further comprises a third radius R3 between a wall surface of the inner wall and the sealing portion. In an embodiment the third radius R3 is 1.0-3.0 mm, preferably 1.5 mm. This third radius facilitates the production since it avoids any risk of scratching the sealing portion surface when ejecting the cover from its mould.

In a further preferred embodiment the thickness T of the inner wall is between 0.4-1.2 mm, preferably about 0.7 mm. The thickness of the inner wall is chosen to optimize an the one hand the compression force the sealing portion exerts to the inner surface of the container body flange. On the other hand, it has found out that it is favourable to avoid material accumulations at the sealing portion since the sealing portion is—time wise—the last portion of the injection mould that is filled. By reducing the wall thickness material accumulations are avoided and subsequently material defects like sink marks are avoided. It was found out that the less material is used at the sealing portion the better the final geometry and the better the air tightness of the final container.

In a further embedment the sealing portion of the inner wall cooperates with an inner side of a flange of the container body in order to air tight seal the container. Since the sealing portion at the container body is the inner side of a flange again the sealing face is protected as good as possible. When compared to the outer side of the flange for example a much better protection of the surface and subsequently a better air tightness results.

Preferably, the inner wall further comprises a chamfer opposite to the sealing portion. Since the sealing portion of the inner wall comprises a radius which forms an apex at the outer side a chamfer at the inner side is provided which locally eliminates the increase of the wall thickness in this area. The chamfer therefore further prevents a material accumulation, prevents material defects like sink marks and thereby increases the air tightness of the container.

In a further preferred embodiment said cover is produced independently and separately from said container body and the cover is detachably connected to the container body. This allows producing the cover of a different material than the container body which may further increase air tightness of the container due to a special material selection of both parts.

Preferably, the container body comprises a first connecting means and the cover comprises a second connecting means integral with the hinge, wherein the container body and the cover are detachably connected with each other by connecting the first with the second connecting means. The hinge can preferably be used for attaching a connection means to the cover.

Preferably the second connecting means is provided with at least one snapping hook and the first connecting means is provided with at least one recess for accommodating the snapping hook in order to connect the cover at the container body. This provides a snap connection of cover and container which can be made by simply inserting the second connecting means into the first connecting means.

In a further preferred embodiment the first connecting means is integral with the container body. In this case the container consists of only two separate parts container body and cover.

Preferably the hinge is a foil hinge. Foil hinges are very reliable and provide an exact rotation axis of the cover with respect to the container body. This facilitates a very exact positioning of the cover during the closing movement which guarantees that the inner wall with the sealing portion is not damaged during closing the cover.

In a further preferred embodiment the container comprises an insert which essentially covers the inner surface of the container body, wherein the insert is made of a different material compared to the container body. By providing an insert within the container body the inner surface which contacts the stored goods can be made of an appropriate material which can be different to the material of the container body. For example it can be favourable for medical applications to produce the insert of an inert material.

Further advantages, details and characteristics result from the sub claims.

4. SHORT DESCRIPTION OF THE DRAWING

In the following an embodiment of the invention will be explained in more detail by means of the figures. Therein shows:

5. DETAILED DESCRIPTION OF PREFERRED EMBODIMENTS

In the following preferred embodiments of the invention are shown with respect to the figures.

Figure 1:
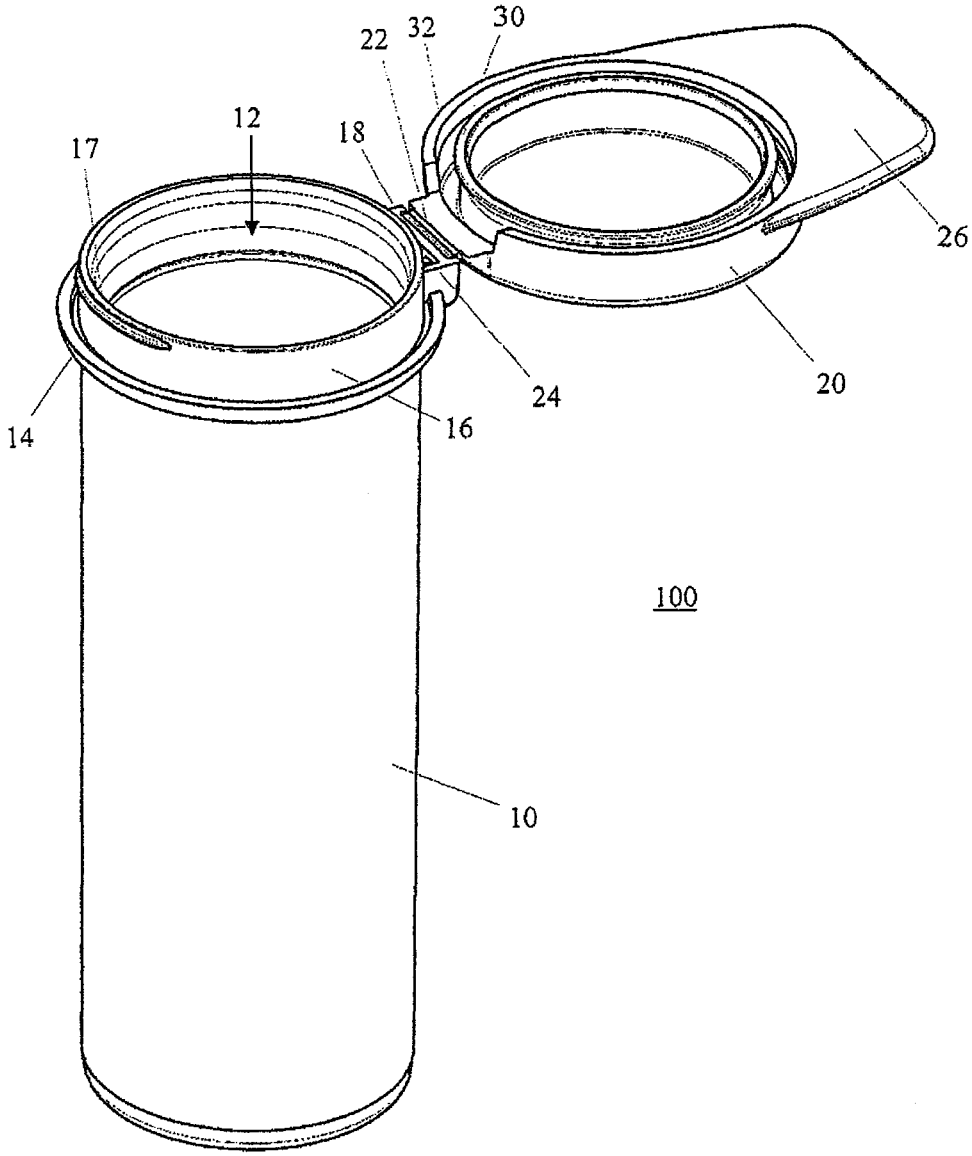
FIG. 1 is a three dimensional drawing of a container of container body and mounted cover in open condition.

FIG. 1 shows an air tight container 100 according to the invention. The container 100 consists of a container body 10 and a hinged cover 20 and can be used for example to store medical goods such as test strips for blood glucose measurement. The container body 10 has an opening 12 which is surrounded by a flange 16. The cover 20 can rotate around a foil hinge 22 for closing and opening of the container 100.

A bead 14 which surrounds the container body 10 extends outwards from the flange 16 and acts as a stop for the cover 20 in closed condition.

The cover 20 is detachably connected to the container body 10 by means of a first connecting means 18 integral with the container body 10 and a second connecting means 24 integral with the hinge 22. The second connecting means 24 comprises two snapping hooks on opposite sides or one snapping hook on the total length of the hinge 22 or a combination of both which engage corresponding recesses at the first connecting means 18. To establish the connection it is just required to insert the second connecting means 24 into the first connecting means 18.

Figure 2:
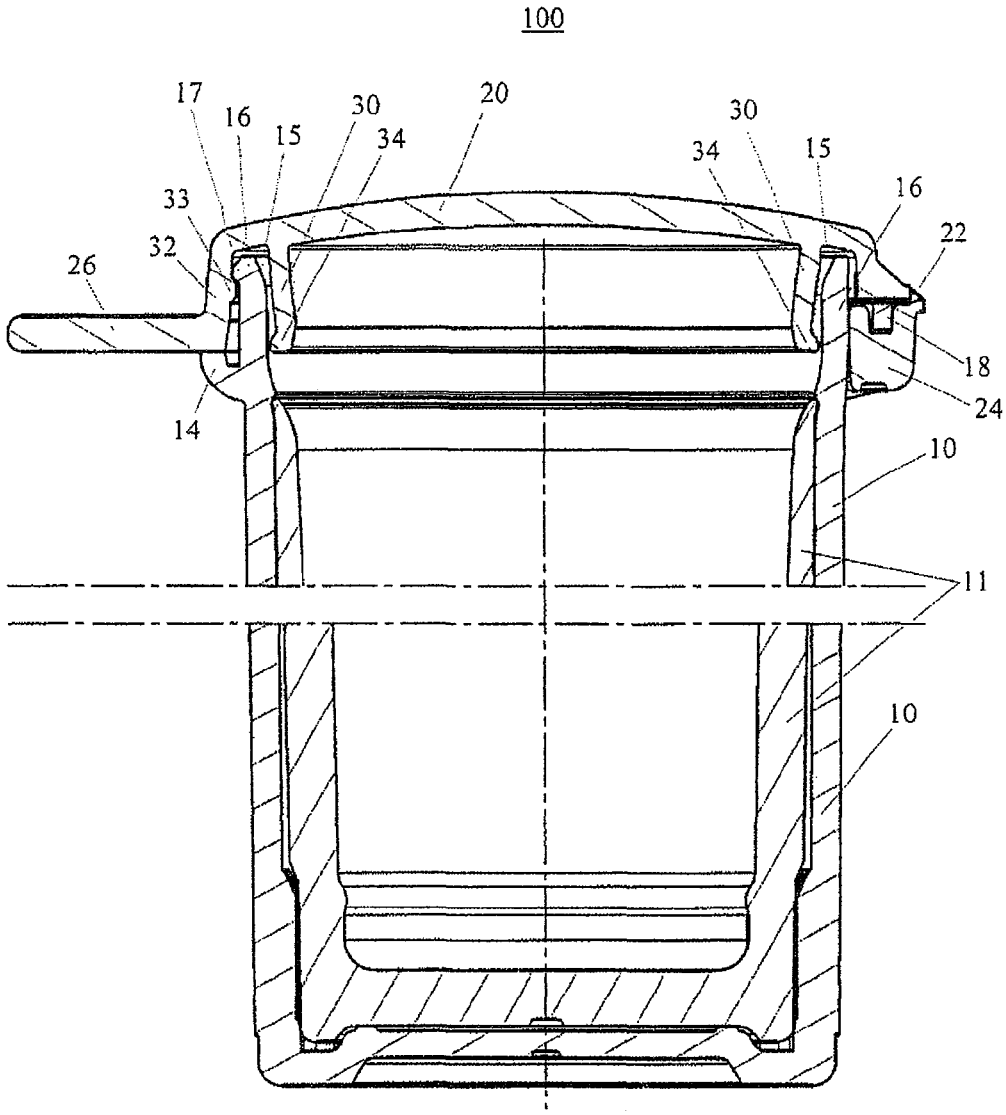
FIG. 2 is a partial lateral sectional view of the container according FIG. 1 in closed condition.

FIG. 2 shows in a partial sectional view the container 100 in closed condition. Particularly, it shows how the air tight sealing between container body 10 and cover 20 is established. To this end the cover 20 comprises a cylindrical inner wall 30 which has the actual sealing and a cylindrical outer wall 32 which basically act for mechanically holding the cover 20 in place.

The inner wall 30 is provided with a sealing portion 34 at the outer edge of the inner wall 30. This sealing portion cooperates with the inner surface of the flange 16 to air tight seal the container 100.

For facilitating the closing of the cover 20 and to prevent any damages of the sealing portion 34 the flange 16 is provided with a chamfer 15 at the upper inner side. Further, the inner surface of the flange 16 has is provided very even and smooth. For holding the cover 20 in place in closed condition it is provided with a projection 33 which engages a corresponding protrusion 17 on the outer surface of the flange 16. In order to open the container 100 the cover 20 comprises a thumb tab 26 which is arranged below the projection 33 at the outer wall 32. By pressing the thumb tab 26 from below the outer wall 32 bends slightly outwards and the projection 33 moves over of the protrusion 17 and allows the cover 20 to be opened. Of course also a recess can be provided at the flange 16 and the corresponding projection can be provided at the cover 20.

The clipping of the cover 20 at the container body 20 is separate from the sealing. The seal (apex 36 of sealing portion 34) engages the inner surface flange 16 without any recess. The risk of damaging the sealing surface when opening or closing the cover 20 is therefore significantly reduced.

FIG. 2 further shows an insert 11 which can be made of a special material within the container body 10. Preferably the insert is made of a desiccant entrained polymer whereas the cover 20 and the container body 10 are made of PP.

Figure 3:
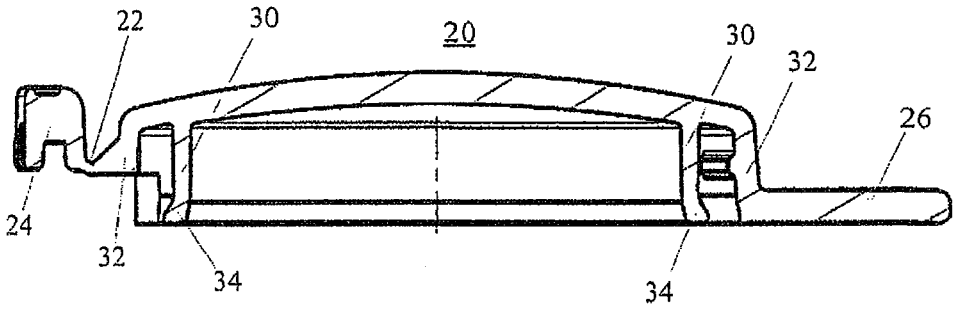
FIG. 3 is a lateral sectional view of a cover of the container according FIGS. 1 and 2.
Figure 4:
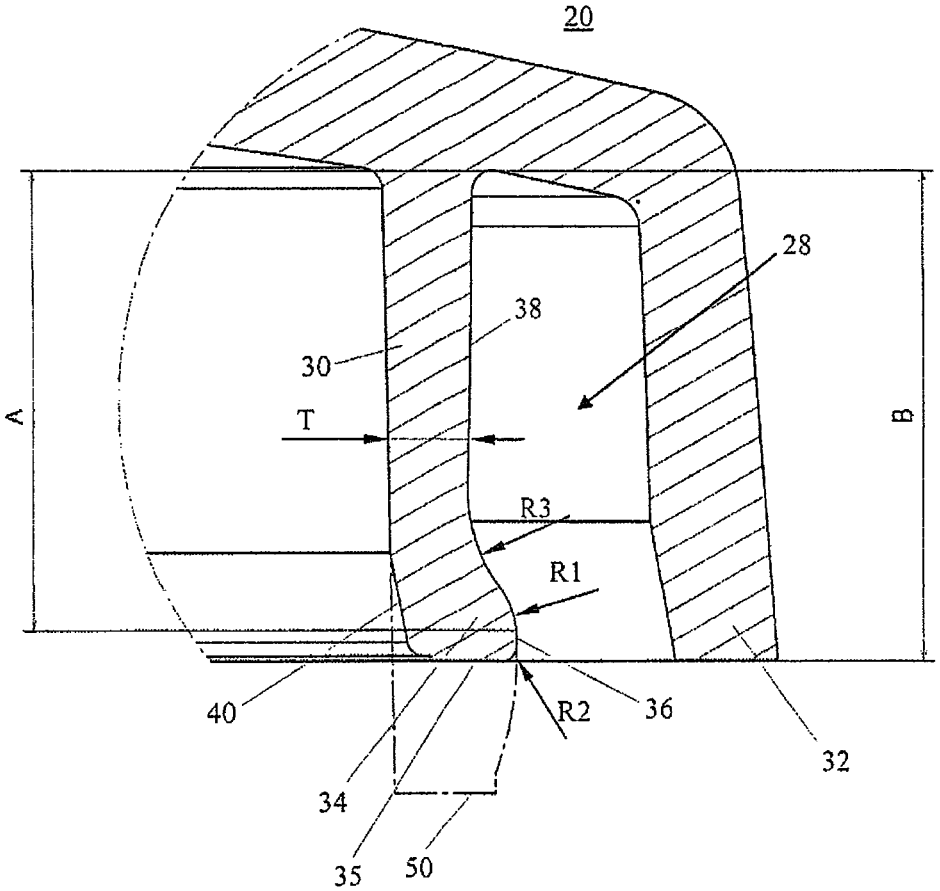
FIG. 4 is an enlarged detail of a lateral sectional view of a cover according FIG. 3.

FIGS. 3 and 4 show the details of the cover 20 particularly the elements of the sealing portion 34 at the inner wall 30. The sealing portion 34 comprises an apex 36 which is defined by a first radius R1 and which forms the actual contact line with the inner surface of the flange 16. The first radius can be 0.5-3.0 mm, preferably 0.7-0.9 mm and more preferably it is 0.8 mm.

The apex 36 is arranged at the outer edge of the inner wall 30 and faces the outer wall 32. Between outer wall 32 and inner wall 30 a groove 28 is provided, which accommodates the flange 16 in closed condition of the container 100.

As it can be seen in FIG. 4, the vertical position A of the apex 36 is smaller than the vertical height B of the outer wall. Therefore, the outer wall 32 protects the apex 36 from undesired contact with other elements, what may lead to damages of the apex 36 that forms the actual sealing. This leads to an increased reliability of the container 100 in view of air tightness.

The vertical position A of the apex 36 of the sealing portion 36 can be 2.0-15.0 mm, preferably 3.9 mm and the vertical height B of the outer wall 32 can be 2.1-15.1 mm, preferably 4.2 mm. Therefore, the apex of the sealing portion is protected by a preferably 0.3 mm higher outer wall 32.

The sealing portion 34 further comprises a second radius R2 between the first radius R1 and an end surface 35 of the inner wall 30. The second radius R2 is smaller than the first radius R1. In an embodiment the second radius R2 can be 0.05-2.0 mm, preferably 0.10-0.50 mm and more preferably 0.15 mm. This second radius R1 eliminates the risk of damaging (for example scratching) the inner wall surface of the container body 10 and thereby improves again air-tightness of the container 100. Further, the small radius R2 ensures that the distance between the apex 36 and the end surface 35 is small such that the sealing line is close to the lower end of the inner wall 36 which has manufacturing advantages. Particularly, this avoids material accumulation at the sealing portion 34 which eliminates defects like sink marks.

Further, the inner wall 30 comprises a third radius R3 between a wall surface 38 and the sealing portion 34. This third radius R3 can be 1.0-3.0 mm more preferably 1.5 mm. It facilitates the production of the cover 20 since it avoids any risk of scratching the sealing portion surface when the cover 20 is ejected from its mould.

The thickness T of the inner wall 30 is chosen to optimize on the one hand the compression force the sealing portion 36 exerts to the inner surface of the container body flange 16. On the other hand, as mentioned above it has found out that it is favourable to avoid material accumulations at the sealing portion 34 since the sealing portion 34 is—time wise—the last portion of the injection mould that is filled. By reducing the wall thickness T material accumulations are avoided and subsequently material defects like sink marks are avoided which improves geometry of the sealing portion 36 and the air tightness of the container 100. The thickness T of the inner wall 30 can be 0.4-1.2 mm, preferably about 1.2 mm.

For this reason the inner wall 30 further comprises a chamfer 40 opposite to the sealing portion 34.

Measurements within a climate chamber of moisture uptake showed a significant improvement in view of moisture ingress compared to a different container with a closure that shows an inner wall of the shape indicated by outline 50. A container according the invention only had moisture ingress of 0.20 mg a day, whereas a container with the alternative inner wall design 50 showed a moisture ingress of 0.30 mg a day. This means a moisture ingress reduction of 35%.

In order to evaluate the seal performance of vials according to the invention, a comparative test was carried out on two families of vials with identical geometry as regards the outside dimensions and the exchange surfaces, but with a different design of the seal:

The first vial family had a seal according to the invention.

The second vial family had a seal design as known from U.S. Pat. No. 6,769,558 cited in the introductory part of the specification.

10 vials of each family were stored inside a moisture and temperature regulated climate chamber. The moisture ingress was measured by recording the gravimetric weight uptake of the vials including a desiccant (water vapour ingress is trapped by the desiccant resulting in an increase of weight of the samples).

The following table records the average weight uptake per day at different times of experimentation.

Moisture Ingress (means value in mg/day) recorded at 30% C, 60% rH

| | Test duration (days) | | | |
|---|---|---|---|---|
| | 28 | 73 | 112 | 133 |
| Vial according to the invention | 0.22 | 0.21 | 0.20 | 0.19 |
| State of the art vials | 0.29 | 0.31 | 0.30 | 0.31 |

The results demonstrate the considerably reduced moisture ingress of the vial according to the prior known vial and demonstrates the improvement achieved by the invention.

List of Reference Signs:

| | |
|---|---|
| 10 | container body |
| 11 | insert |
| 12 | opening |
| 14 | bead |
| 15 | chamfer |
| 16 | flange |
| 17 | protrusion |
| 18 | first connecting means |
| 20 | cover |
| 22 | hinge |
| 24 | second connecting means |
| 26 | thumb tab |
| 28 | groove |
| 30 | inner wall 32 outer wall |
| 33 | projection |
| 34 | sealing portion |
| 35 | end surface |
| 38 | wall surface |
| 40 | chamfer |
| 50 | alternative design |
| 100 | Container |
| R1 | first radius |
| R2 | second radius |
| R3 | third radius |
| A | vertical position of apex |
| B | vertical height of outer wall |
| T | thickness of inner wall |

The invention claimed is:

1. Container for loosely stored products comprising a) a container body;

b) a cover; and c) a hinge placed between the container body and the cover; characterized in that the cover comprises i. a cylindrical inner wall having an outwardly facing sealing portion with an apex forming a sealing line that seals against the inner surface of a flange of the container body when the cover is in a closed condition, and ii. a cylindrical outer wall having an inwardly facing projection that holds the cover in the closed condition on the container body wherein the cylindrical outer wall protects the sealing line of the apex of the sealing portion of the cylindrical inner wall;

wherein the sealing line of the apex is vertically positioned between the projection and an end of the cylindrical outer wall and wherein the seal between the sealing line of the apex of the cylindrical inner wall and the inner surface of the container body provides the only seal between the container body and the cover when the cover is in the closed condition.

2. Container according to claim 1, wherein the vertical position of the sealing line of the apex of the sealing portion is 2.0-15.0 mm, and the vertical height of the outer wall is 2.1-15.1 mm.

3. Container according to claim 1, wherein the apex in a transversal section is provided with a first radius.

4. Container according to claim 3, wherein the first radius is 0.5-3.0 mm.

5. Container according to claim 3, wherein the sealing portion comprises a second radius between the first radius and an end surface of the inner wall, wherein the second radius is smaller than the first radius.

6. Container according to claim 5, wherein the second radius is 0.05-2.00 mm.

7. Container according to claim 5, wherein the inner wall further comprises a third radius between a wall surface of the inner wall and the sealing portion.

8. Container according to claim 7, wherein the third radius is 1.0-3.0 mm.

9. Container according to claim 1, wherein a thickness of the inner wall is between 0.4-1.2 mm.

10. Container according to claim 1, wherein the inner wall further comprises a chamfer opposite the sealing portion.

11. Container according to claim 1, wherein said cover is produced independently and separately from said container body and the cover is detachably connected to the container body.

12. Container according to claim 11, wherein the container body comprises a first connecting means and the cover comprises a second connecting means integral with the hinge, wherein the container body and the cover are detachably connected with each other by connecting the first with the second connecting means.

13. Container according to claim 12, wherein the second connecting means is provided with at least one snapping hook and the first connecting means is provided with at least one recess for accommodating the snapping hook in order to connect the cover at the container body.

14. Container according to claim 12, wherein the first connecting means is integral with the container body.

15. Container according to claim 1, further comprising an insert, which essentially covers an inner surface of the container body, wherein the insert is made of a different material than the container body.

16. Container according to claim 1, wherein the cylindrical inner wall does not extend past the end of the cylindrical outer wall.

17. Container according to claim 1, wherein the sealing line of the apex engages the inner surface of the container body without any recess.

18. The container of claim 10, wherein the chamfer prevents damage to the sealing portion of the cylindrical inner wall when the cover is brought into the closed condition on the container body.

19. The container of claim 1, wherein an outer surface of the container body further comprises an outwardly facing protrusion that engages the inwardly facing projection of the cylindrical outer wall of the cover when the cover is in the closed condition.

20. The container of claim 1, wherein the cover further comprises a thumb tab, and wherein the cylindrical outer wall of the cover is bent outwards when a user presses on the thumb tab from below to open the container.

21. Container of claim 1 wherein the inner surface of an upper portion of the container body comprises a chamfered portion, which chamfered portion assists in the opening and closing of the cover on the container body.

* * * * *